United States Patent [19]

Kashiwagi

[11] Patent Number: 4,482,621

[45] Date of Patent: Nov. 13, 1984

[54] TWO-COMPONENT TYPE DRY DEVELOPER

[75] Inventor: Michio Kashiwagi, Otsu, Japan

[73] Assignee: Toray Industries, Inc., Japan

[21] Appl. No.: 483,517

[22] Filed: Apr. 11, 1983

[30] Foreign Application Priority Data

May 17, 1982 [JP] Japan ..... 57-81504

[51] Int. Cl.[3] ..... G03G 9/10

[52] U.S. Cl. ..... 430/107; 430/108; 430/111

[58] Field of Search ..... 430/107, 108, 111

[56] References Cited

U.S. PATENT DOCUMENTS 3,969,251 7/1976 Jones et al. ..... 430/111
4,108,786 8/1978 Takayama et al. ..... 430/106.6
4,125,667 11/1978 Jones ..... 430/106.6
4,287,283 9/1981 Watanabe et al. ..... 430/108
4,379,825 4/1983 Mitushashi ..... 430/98

OTHER PUBLICATIONS

Narusawa et al. "Triboelectrical Properties of Toner and Carrier", pp. 75–78.

*Primary Examiner*—Mary F. Downey
*Attorney, Agent, or Firm*—Barnes & Thornburg

[57] ABSTRACT

A two-component type dry developer consisting of a mixture of a toner and a magnetic carrier. The toner contains a resin as its main component. The magnetic carrier has a specific surface area of 100 to 300 $cm^2/g$ and a shape factor of not less than $5.5\times10^{-2}$ and less than $8.0\times10^{-2}$. The product of flowability and true specific gravity of the magnetic carrier is 100 to 190 sec/50 g.

49 Claims, 5 Drawing Figures

TWO-COMPONENT TYPE DRY DEVELOPER

BACKGROUND OF THE INVENTION

The present invention relates to a two-component type dry developer, particularly to a two-component type dry developer most suitable as a developer for a printer and a copying apparatus using an electrophotographic process.

An electrophotographic process is frequently utilized in a printer and a copying apparatus (hereinafter referred to as the "printer"). Typically, an electrostatic latent image is first formed on a photosensitive medium such as a photosensitive drum and the image is subsequently made visible by exposure to toner during development. Although the toner produces a visible image on the photosensitive medium, the toner image is typically transferred and fixed to another suitable medium such as paper.

The two-component type dry developer (hereinafter referred to as the "developer") consists of a mixture of a toner and a carrier. Typically, the toner becomes fixed to the photosensitive medium during development due to the electrostatic force of attraction between the photosensitive medium and the oppositely charged toner particles. Development of the latent image is possible only if the toner particles are adequately charged. Toner is charged as a result of sufficient frictional contact with the carrier. However, the toner is relatively soft due to its high resin content and the carrier, consisting of iron powder, is rather hard. Thus, the surfaces of the carrier gradually becomes contaminated with toner during the frictional process. This developer deterioration due to contamination of the carrier surfaces by toner poses serious problems, particularly in high speed printers where the carrier and toner strike each other violently.

Conventional developers used in high speed printers generally consist of a mixture of a toner containing resin as its principal component and a magnetic carrier consisting of nearly perfectly spherical iron powder particles. The use of spherical carrier material in the conventional developer reduces the severity of the impact caused by the collision between the toner and carrier and thus contamination of the carrier surfaces is retarded. However, such conventional developers have the following drawbacks.

The spherical carriers mentioned above have fewer points for contact than other types of carriers, such as needle, rod or plate-like carriers. Therefore, the resistivity of the developer is fairly high making it difficult for a electric current to flow. As a result, the tone has a tendency to adhere only to the boundaries of image planes. This phenomenon is often referred to as the "edge effect". Occurrence of the edge effect not only results in obscureness of the image but also makes it virtually impossible to reproduce the original image density and mutual spacing in the printed image plane. The image density and mutual spacing characteristics frequently provide important information, bar code symbols being a prime example.

A further disadvantage of the above-mentioned conventional developer is the difficulty in controling the concentration of the toner. Optimally, a developer should contain only enough toner to produce a single-layer on the surfaces of individual carriers. Unfortunately, the use of spherical carriers results in an extremely sharp distribution of the specific surface area and it thus becomes difficult to control the supply of toner to be used during the development by the toner. Optimization of toner concentration for conventional developers using spherical carriers is difficult.

Furthermore, the conventional developer has the additional disadvantage of having a weak magnetic force because of its spherical form. The weakness of the magnetic force tends to cause the developer to disperse from the surface of the magnetized roll used for the transport following toner development. Therefore, image quality is degraded due to the poor development as a result of the collisions between the dispersed carriers and the surface of the electrostatic latent image-forming medium. These collisions disfigure the surface of the photosensitive medium. This phenomenon is increasingly apparent in high speed printers in which the magnetized rolls rotate at high speeds. Although this problem, in fact, can be solved by enlarging the carrier particle diameter and strengthening the magnetic force, such an approach also aggravates the edge effect.

On the other hand, in developers in which needle, rod and plate-like carrier are used, the carriers have many contact points compared to the spherical carrier. This feature produces a print with a good black image. Good results are obtained because the inherent low resistivity of these structures allows current to flow easily. Since the geometry of the carrier allows a wide range of toner distribution along its surface area, it is easy to control the optimal value of the toner concentration. In addition, there is virtually no problem of the developer dispersing from the surface of the magetized roll since the carrier has a strong magnetic force when used in a high speed printer. However, contamination of the carrier surfaces by the toner is significantly increased and progresses rapidly due to the sharp corners of this type of conventional carriers. In this way, the life of the developer is shortened and the brush-in magnetic "brushes" become stiff due to the strong magnetic force. This causes the magnetized roll to bear an excessive load, making it impossible in some instances to achieve the high speed development.

SUMMARY OF THE INVENTION

An object of the present invention is to provide a long service life developer that produces minimal image degradation even when used in high speed printers.

Another object of the present invention is to provide a developer which causes a minimal edge effect even when used in high speed printers.

A further object of the present invention is to provide a developer which does not disperse from the surface of the magnetized roll even when used in high speed printers.

Still another object of the present invention is to provide a developer in which it is easy to control the toner concentration.

In order to achieve the above objects, in the present invention, a two-component type dry developer is proposed which consists of a mixture of a toner containing a resin as its main component and a magnetic carrier. This magnetic carrier has a specific surface area of 100 to 300 $cm^2/g$, a shape factor of not less than $5.5\times10^{-2}$ but less than $8.0\times10^{-2}$, and a product of flowability and true specific gravity of 100 to 190 sec/50 g.

DRAWINGS

DETAILED DESCRIPTION OF THE INVENTION

Figure 1:
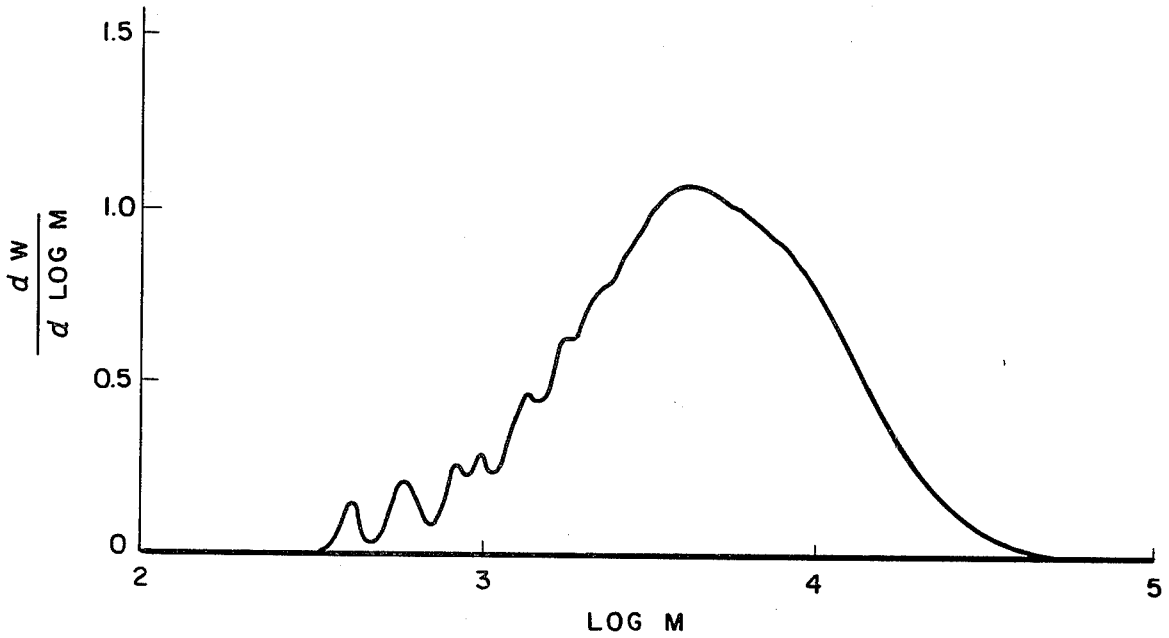
FIG. 1 is a graph of the derivative curve of molecular weight distribution which was measured using a sample of the toner in the developer of the present invention.

The developer representing the present invention consists of a mixture of a toner containing a resin as its principal component (at least 50 percent by weight but preferably not less than 80 percent by weight) and a magnetic carrier. The mixing ratio by weight of toner to carrier is between 0.5:99.5 to 50:50 (preferably between 1:99 to 25:75). The developer may contain only enough toner to coat one layer on the surface of individual carriers. In addition, the developer of the present invention can retain a positive or negative charge depending on the composition of toner by the friction between the toner and carrier.

The above-mentioned toner produces print information on the electrostatic latent image-forming medium or transfer medium of a printer. Therefore, the toner, in the fixing process of the above-mentioned electrophotographic process, must easily and reliably adhere to the electrostatic latent image forming medium or transfer medium by heat or pressure, or both. The resin used as the main toner component includes: natural resins (balsam, rosin, shellac, copal, etc.), modified natural resins (the above-mentioned natural resins modified by synthetic resin such as vinyl resin, acrylic resin, alkyd resin, phenolic resin, oleo resin and maleic resin), synthetic resins, natural rubbers (cis-1,4-polyisoprene, as essential component), and synthetic rubbers (rubbers such as chlorinated rubber, cyclized rubber, isobutylene rubber, ethylene-propylene rubber, ethylene-propylene-diene rubber, butadiene rubber, butyl rubber, styrene-butadiene rubber, acrylonitrile butadiene rubber, etc.).

The above-mentioned synthetic resins are further explained:

Epoxy resins: phenolic type epoxy resins (bisphenol-A type epoxy resin, novolak type epoxy resin, polyphenolic type epoxy resin, polyhydroxybenzene type epoxy resin, etc.), aromatic carboxylic acid type epoxy resins (hydroxycarboxylic acid type epoxy resin, aromatic dicarboxylic acid type epoxy resin, etc.), vinyl polymer type epoxy resins, alicyclic compound type epoxy resin, and so-called modified epoxy resins of these resins modified by phenolic resin, melamine resin, urea resin, xylene resin, polyester resin, polyurethane resin, silicone resin, furfural resin, polyamide resin, acrylic resin, vinyl chloride resin, rubber, etc.

Vinyl resins: vinyl chloride resin, vinylidene chloride resin, vinyl acetate resin, polyacetal resin (polyvinylbutyral resin, for example), vinyl ether resin.

Acrylic resins: polyacrylic ester, polymethacrylic ester, copolymer of acrylic acid, copolymer of methacrylic acid.

Olefin resins: polyethylene resin, polypropylene resin, polystyrene resin, copolymer of ethylene, copolymer of styrene.

Polyamide resins: nylon-12, nylon-6, nylon-66.

Polyester resins: polyethylene terephthalate, polyethylene isophthalate, copolymer of polyethylene terephthalate and polyethylene isophthalate, polytetramethylene terephthalate, polytetramethylene isophthalate, copolymer of polytetramethylene terephthalate and polytetramethylene isophthalate.

Alkyd resins: phthalic acid resin, maleic acid resin.

Amino resins: urea-formaldehyde resin, melamine-formaldehyde resin.

Further, in the present invention, the toner may be a mixture of two or more of the resins mentioned above. A toner, for example, consisting of a mixture of polystyrene resin and acrylic resin whose ratio by weight ranges from 6:4 to 9:1, is easy to remove from the surface of a toner fixing heated roller and is able to prevent offset due to the residual toner on the roller surface. Hence, a developer comprising such a toner is suitable for use in a printer employing a toner fixing heated roller process.

It is also possible, to mix the toner, in a range of 0.1 to 40 percent by weight, with such low-melting-point materials as: wax (n-hexadecane, n-eicosane, petroleum wax, etc.), metallic salts of fatty acids (calcium stearate, magnesium stearate, etc.) and low molecular weight compound of synthetic resins (low molecular weight polyethylene, low molecular weight polypropylene, etc.). Such a mixture is easily fixed to the photosensitive medium even though energy consumption is reduced by lowering the temperature of toner-fixing heated roller. An example of such a toner is one consisting of the above-mentioned mixture of resins to which paraffin wax has been added in a proportion of 1 to 10 percent by weight. Further, the toner may contain coloring agents for the purpose of coloring the print information on the electrostatic latent image forming medium or transfer medium. As coloring agents, such pigments as carbon black, acetylene black, lamp black and calcium carbonate as well as dyestuffs such as nigrosine and other organic complex can be used. As organic complex, titanate or carbonate such as calcium or barium is suitable. Such coloring agents are normally mixed in a proportion of 0.1 to 15.0 percent by weight.

In addition, the toner may contain as a charge control agent, 0.1 to 15.0 percent by weight, electron donor dyestuff such as nigrosine or electron acceptor organic complex such as monoazo dye metallic complex and metallic salt obtained from ethendiol.

The preferred average particle size of the toner ranges from 5 to 50 microns, further preferably from 8 to 15 microns. That is, when the toner particle is too small, intrusion of toner occurs in the electrostatic latent image forming medium or transfer medium. For example, the structure of paper will permit a smear to easily be produced. Desirably, sufficiently small toner particles are used so that a resolution in the order of 5 lines per 1 mm is obtainable, too large particle size of a toner is not desirable.

The preferred toner in the developer of the present invention to be used in a printer employing the flash fusing process must consist mainly of B-stage epoxy resin, especially B-stage bisphenol-A type epoxy resin.

A B-stage bisphenol-A type epoxy resin denotes one in an intermediate state wherein bisphenol-A type epoxy resin undergoes a swelling but does not completely dissolve when brought into contact with such liquids as alcohol or acetone and wherein it is softened in a rubbery state but does not completely melt on heating.

The flash fusing process achieves fixing by applying 200 to 300 joules of heat to the toner by irradiating the toner image with the emission spectrum of the xenon or halogen gas for the very brief period of 0.1 to 1 millisecond. Therefore, the toner must be easily softened by applying the 200 to 300 joules of heat. Also, the toner is required to not decompose in the presence of irradiation of the emission spectrum of the xenon or halogen gas. Such decomposition can produce a poisonous or bad-smelling gas. In this regard, bisphenol-A type epoxy resin is best suited. Furthermore, keeping such an epoxy resin at B-stage, which is harder than at A-stage and which is capable of lowering the tackiness of the toner, can lengthen, to a large extent, the time interval before the surface of the carrier becomes completely contaminated by the toner. Also, B-stage epoxy resin can lengthen the life of the developer, even when the developer is used in a printer whose printing speed is over 2,500 lines/min at a 1/6 inch line pitch. In addition, the ease of fixing is almost the same as when using a resin at A-stage.

The bisphenol-A type resin used in the above-mentioned case preferably contains virtually no oligomer component. Moreover, since the toner becomes relatively hard and less tacky, it is possible to lengthen the time needed for the surface of the carrier to become completely contaminated by the toner without significantly diminishing the ease of fixing the toner to the photosensitive medium. The feature further improves the life of the developer.

The above-mentioned bisphenol-A type epoxy resin contains not more than 10 percent by weight of oligomers (monomer, dimer and trimer) and not more than 2.5 percent by weight of monomer. Preferably, the bisphenol-A type epoxy resin contains not more than 1.5 percent by weight of monomer.

In the above case, the presence of oligomers can be detected using conventional gel permeation chromatography. For example, a chromatogram of a tetrahydrofuran solution of bisphenol-A type epoxy resin along a column is calibrated in molecular weight using a chromatogram of a tetrahydrofuran solution of polystyrene under the same condition. The data accumulated through use of this technique can be extrapolated to provide a standardized differential curve of molecular weight distribution of the resin sample. Peaks on this curve appear at each degree of polymerization. Hence the $(S_1/S_2)\times 100$ value is calculated by computing the area, $S_2$, under the entire curve and the area, $S_1$, under the portion of the curve at the lower peaks of up to and including the trimer. The calculated values indicate the percents by weight of the oligomers. The monomer content percentage can be determined by following the same procedure with the monomer peak.

On the other hand, the carrier consists of metals such as iron, manganese, cobalt, nickel, etc.; metal oxides such as iron sesquioxide, tri-iron tetraoxide, etc.; and magnetic materials such as ferrites representd by $MFe_3O_4$ (where M is Mn, Co, Ni, Mg, Zn or Cd). It has particle sizes of 5 to 300 microns, preferably 10 to 200 microns. The carrier consisting of metals or metal oxides may be coated with an oxide to prevent oxidization. For example, annealing the iron carrier forms a film of iron oxide of several microns thick on the carrier surface. Also, a coating consisting of a similar or dissimilar resin to the toner of the present invention may be further applied directly or on the above-mentioned oxide film to prevent variation in resistivity and to regulate the charging characteristics. For example, a carrier coated wih epoxy resin or polytetrafluoroethylene resin shows negative charge characteristics and a carrier coated with acrylic resin positive charge characteristics.

Since toner depleted during development may be supplemented when necessary, the useful life of the developer is substantially the same as the life of the carrier, that is, the length of time for the surface of the carrier to become entirely contaminated by the toner. The life of the carrier is extendable by enlarging or altering the shape of the carrier surface to lessen the toner contamination rate. Accordingly, the specific surface area of the carrier should be enlarged and the shape factor of the carrier should be kept within a sepcified range.

The specific surface area of the carrier, in the present invention, must be 100 to 300 $cm^2/g$. Desirably, the specific surface area of the carrier is 120 to 250 $cm^2/g$, so that the developer life is compatable with life requirements of high speed printers. Such printers have printing speeds that are at least 2500 lines/min, or preferably not lower than 5000 lines/min, at 1/6 inch line pitch. In this case, the specific surface area of the carrier is measured by the air permeability method standardized in JIS R5201-1981.

In the present invention, the carrier must have a shape factor of not less than $5.5\times 10^{-2}$ and less than $8.0\times 10^{-2}$. A conventional spherical carrier is preferred because it reduces impacts during collision with the toner and retards the progress of the carrier surface contamination. However, high resistivity and edge effects result from the use of such a carrier. The sharp distribution of the specific surface area inherent to conventional spherical carriers makes control of the toner concentration difficult. There is also the problem that the developer is easily dispersed from the surface of the magnetized roll. By contrast, the use of carriers having sharp corners such as needle, rod and plate-like carriers do not promote the undesirable edge effect, but unfortunately significantly increase the carrier surface contamination due to the toner. Consequently, in the present invention, a carrier is used that is not a perfect sphere and yet does not have extremely sharp corners but which has a shape factor of not less than $5.5\times 10^{-2}$ and less than $8.0\times 10^{-2}$, preferably not less than $5.5\times 10^{-2}$ and not more than $7.0\times 10^{-2}$. In this case, the shape factor is defined as the projected unit area of the carrier divided by the square of the perimeter of projection. The above-mentioned value denotes a simple mean of the values measured for a number of carrier particles.

The product of flowability and true specific gravity represents the ease of carrier flow. When carrier flow is very difficult, violent frictional collisions occur between the carrier and toner. This circumstance accelerates the contamination of the carrier surface by the toner and shortens the life of the developer. By contrast, when carrier flow is extremely easy, there is less friction between the carrier and toner. This latter condition is preferable since it inhibits the contamination of the carrier surface. However, it also reduces the charging characteristics, making it impossible to obtain an image having adequate contrast. Therefore, in the present invention, the product of flowability and true specific gravity is selected within the range of 100 to 190 sec/50 g, preferably 120 to 190 sec/50 g, to avoid the shortcomings mentioned above. In this case, the flowability is measured by the method standardized in JIS Z2502-1979. However, since the flowability depends on the true specific gravity, in the present invention, the product of the above-mentioned flowability and true specific gravity is used as an indicator of the ease of flow with a view to exactly representing the flowability of the developer even when the material for the carrier is altered. The true specific gravity is measured by the method standardized in JIS R6125-1976. Here, the smaller the product of flowability and true specific gravity, the more easily the carrier, and consequently, the developer will flow.

The developer used with the present invention can be produced as follows:

First, the appropriate resin material is melted and, as necessary, pigments, dyestuffs, charge control agents and dispersing agents are added and thoroughly mixed. The mixture is then cooled to room temperature and ground. The resulting product is then remelted, remixed and, after cooling to room temperature, reground. After the above-mentioned procedure is repeated many times, the toner mixture is finally ground. An air classifier is used to select a toner having an average particle size of 5 to 50 microns.

The carrier is prepared by selecting a material powder having the initial proper average particle size which then is crushed using a vibrating or ball mill. The crushed powder is subjected to mechanical abrasion to eliminate corners from the resulting product. Thus a carrier is obtained having a specific surface area of 100 to 300 $cm^2/g$, a shape factor of not less than $5.5\times10^{-2}$ and less than $8.0\times10^{-2}$, and a product of flowability and true specific gravity of 100 to 190 sec/50 g. The values of specific surface area, shape factor and product of flowability and true specific gravity can be kept within the above-mentioned range by proper selection of average particle size of the material powder and crushing time.

The developer is then obtained by mixing the above-mentioned toner and carrier in the desired weight ratio.

The present invention is described in more detail using the following examples:

EXAMPLE 1

The developer, comprising a mixture of toner containing resin as its main component and a magnetized carrier, was prepared.

The toner was prepared as follows:

A resin, A-stage bisphenol-A type epoxy resin, "EPIKOTE" 1004, manufactured by Yuka Shell Epoxy Kabushikikaisha; as pigment, carbon black MA - 100, manufactured by Mitsubishi Chemical Industries, Ltd.; a dyestuff, nigrosine type dyestuff "OIL BLACK" BY, manufactured by Orient Chemical Industries, Ltd.; and a dispersing agent, acrylamide type dispersing agent "ARMID" HT, manufactured by Lion Akzo Company, Ltd., were mixed in the ratio of 84 percent, 7 percent, 7 percent and 2 percent by weight, respectively.

The above mixture was then melted and mixed in a kneader at 170° C. for 30 minutes and then cooled to room temperature to obtain a solid mixture.

The above-mentioned solid mixture was then hammer-milled into powder having a particle size of not more than 100 microns.

The above powder was then melted and mixed again in a kneader at 170° C. for 30 minutes and then cooled to room temperature. It was then hammer-milled again to powder having a particle size of not greater than 100 microns in the same manner as described above.

The above powder was jet-milled and a toner having a particle size between 5 and 25 microns, with an average particle size of about 15 microns, was obtained. In this case, the toner particle size was measured with a TA II type Coulter Counter, manufactured by American Coulter Electronics Limited.

By preparing a 0.25 weight % tetrahydrofuran solution of the above-mentioned toner, the molecular weight distribution was then measured using a GPC-244 Gel Permeation Chromatograph, manufactured by American Waters Associate Inc. For the column, TSK-GEL-G4000$H_8$, TSK-GEL-G3000$H_8$ and TSK-GEL-G2000$H_8$, manufactured by Toyo Soda Manufacturing Co., Ltd., were connected in series and for the detector, an R-401 Differential Refractive-index Detector, manufactured by American Waters Associate Inc., was used. The measurement was made at 25° C. with 0.5 ml of the injected sample and a 1 ml/min flow rate of the carrier gas. Moreover, the undissolved portion in the above-mentioned solution was removed in advance by a centrifuge. The measured results are shown by the differential curve of molecular weight distribution in FIG. 1. In FIG. 1, M in the abscissa denotes the molecular weight and W in the ordinate denotes the content (% by weight) of bisphenol-A type epoxy resin.

The content of oligomers in the above-mentioned toner was determined from the curve, the oligomer content being 6.2% by weight and that of the monomer content being 1.1% by weight, thus the toner did not substantially contain the oligomers. Furthermore, it was confirmed that the above-mentioned resin, initially at A-stage, had been changed to B-stage since the highest peak on the above-mentioned curve had moved to the higher polymerization degree end than that of "EPIKOTE" 1004, when measured in the same manner.

Figure 2:
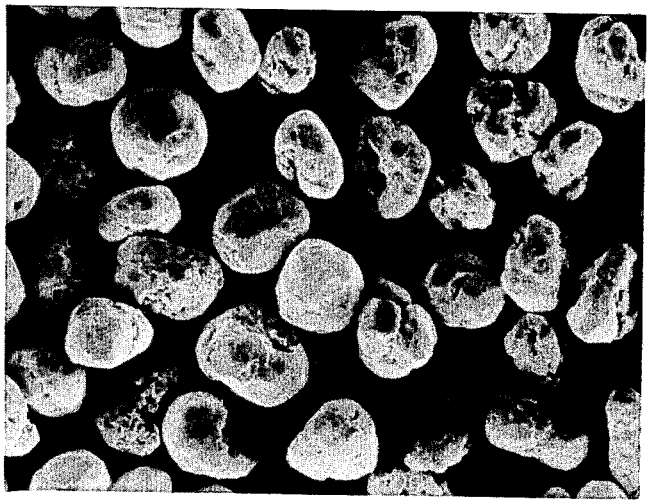
FIG. 2 is a scanning electron microscopic photograph (magnification of 200) of a sample of the carrier in the developer of the present invention.

The carrier was prepared as follows:

Reduced iron powder having a particle size of not more than 70 microns was used as the starting material. It was crushed in a vibrating mill for 5 hours and then particles, whose sizes ranged from 60 to 70 microns, were selected using a gyro-shifter, leaving an iron carrier. The scanning electron microscopic photograph of this carrier (magnification of 200) is shown in FIG. 2.

The result of the measurement made with an SS-100 Powder Surface Area Determinator, manufactured by SHIMADZU CORPORATION, gave a specific surface area of the carrier of about 234 $cm^2/g$. Also, the shape factor, measured with an Image Analyzer "QUANTIMENT" 720, manufactured by British Cambridge Instruments, was about $6.2\times10^{-2}$. In addition, the flowability, measured by the method standardized in JIS Z2502-1979, was about 19 sec/50 g, and the true specific gravity, measured by the method standardized in JIS R6125-1976, was about 7.86. The product of flowability and true specific gravity was about 150 sec/50 g.

The above-described toner and carrier were mixed in the weight ratio of 2:98 in a mixer for 3 hours and ten liters of the developer of the present invention was obtained.

A life test was carried out by operating the magnetized roll at a peripheral speed of 706 mm/sec (corresponding to a print speed of 10,000 lines/min at 1/6 inch line pitch) after 2 kg of the above-mentioned developer had been put into a magnetic brush developing apparatus equipped with the 65 mm diameter, 350 mm long magnetized roll. The life was found to be about 420 hours. In this case, the life means the time required for the charge of the developer measured with a TB-500 Blow-off Powder-charge Measuring Equipment, manufactured by Toshiba Chemical Products Co., Ltd, to be lowered to one-third of the pre-test value. Furthermore, no dispersion of the developer from the surface of the magnetized roll was observed during the operation of the developing apparatus. The ease of controlling the toner concentration was determined by measuring the changes in the charge of the developer when the toner concentration was varied through a range of plus and minus 75% of the standard of 2% by weight. Since almost no change in the charge was found even when the toner concentration was varied through a range from 0.5% by weight to 3.5% by weight, it was confirmed that the toner concentration could easily be controlled.

The print test conducted with the above-mentioned developer using a FACOM 6700D Printer, manufactured by FUJITSU LIMITED, resulted in a good quality image without edge effects or evidence of poor development and the image quality was not diminished to any extent even after 1 million pages had been printed.

EXAMPLE 2

A mixture of copolymer of acrylonitrile and styrene SBM73, manufactured by Sanyo Kasei Co., Ltd., and synthetic rubber "TUFPRENE" AG, manufactured by Asahi Chemical Industry Co., Ltd., in a weight ratio of 20:1, was prepared as the resin. The resin, pigment, dyestuff, and dispersing agent were mixed at a proportion of 84%, 7%, 7% and 2% by weight, respectively. The pigment, dyestuff and dispersing agent used were the same as those used in Example 1.

The mixture was then melted and mixed using a kneading machine at 170° C. for 1 hour and then cooled to room temperature to provide a solid mixture.

The solid mixture was hammer-milled to a powder having a particle size of not more than 100 microns. The powder was further crushed by a jet mill. A classifier was used to select a toner having particle sizes from 5 to 25 microns with an average particle size of 15 microns.

This toner was mixed with the carrier used in Example 1 in a weight ratio of 2:98 to produce a developer in accordance with the present invention.

Life-testing was conducted with the above-mentioned developer in the same manner as in Example 1 and the developer life was determined to be about 450 hours. There was no dispersion of the developer from the surface of the magnetized roll and the toner concentration was easily controlled.

Furthermore, the print test carried out using a U-Bix 600 Copying Apparatus, manufactured by KONISHIROKU PHOTO IND. CO., LTD., resulted in a good quality image without edge effects or poor development.

EXAMPLE 3

A mixture of resins consisting of polystyrene resin "PICCOLASTIC" D-125, manufactured by Exxon Chemicals Industries Ltd., and synthetic rubber "TUFPRENE" AG, manufactured by Asahi Chemical Industry Co., Ltd., in a weight ratio of 10:1 was used instead of the resin mixture of Example 2. A developer in accordance with the present invention was then obtained in the same manner as Example 2.

Life testing was conducted with this developer in the same manner as in Example 1 and the developer showed a life of about 400 hours. No dispersion of the developer from the surface of the magnetized roll was observed and control of the toner concentration was easily achieved. Furthermore, the print test, carried out in the same manner as in Example 2, resulted in a good quality image with no edge effects or poor development.

EXAMPLE 4

A copolymer (melting point: about 146° C.) of polytetramethylene terephthalate and polytetramethylene isophthalate, manufactured by Toray Industries, Inc., was used as the resin. This resin, pigment, dyestuff and dispersing agent were mixed in a ratio of 84%, 7%, 7% and 2% by weight, respectively. The pigment, dyestuff and dispersing agent were the same as used in Example 1.

The above mixture was then melted and mixed in a kneader at 190° C. for 1 hour and then, as in Example 1, a developer in accordance with the present invention was obtained.

A life test was conducted with the above-mentioned developer in the same manner as in Example 1. The life was shown to be about 460 hours. No dispersion of the developer from the surface of the magnetized roll was observed and control of the toner concentration was easily achieved. Furthermore, the print test carried out in the same manner as in Example 2 also resulted in a good quality image without edge effects or poor development.

EXAMPLE 5

A mixture of resins consisting of polyamide resin "POLYMIDE" S72, manufactured by Sanyo Kasei Co., Ltd., and natural resin modified with maleic acid "BECKACITE" 1111, manufactured by Dainippon Ink and Chemicals, Inc., in the weight ratio of 25:18 was used as the resin. This mixture of resins, pigment and dyestuff were mixed in the proportion of 86%, 7% and 7%, by weight, respectively. The pigment and dyestuff were the same as used in Example 1. A developer for the present invention was obtained in the same manner as in Example 1.

A life test was conducted with the above-mentioned developer in the same manner as in Example 1, and the life was found to be about 420 hours. There was no dispersion of the developer from the surface of the magnetized roll and the toner concentration was again easily controlled. Furthermore, the print test, carried out in the same manner as in Example 2, also resulted in a good quality image without edge effects or poor development.

EXAMPLE 6

A mixture of resins consisting of ethylene-vinyl acetate copolymer "EVAFLEX" 210, manufactured by Mitsui Polychemicals Co., Ltd., and paraffin wax "Hi-Mic" 2095, manufactured by Nippon Seiro Co., Ltd., in the weight ratio of 25:18 was prepared as the resin. A developer for the present invention was obtained in the same manner as in Example 4.

As a result of a life test conducted with this developer in the same manner as in Example 1, the life was found to be about 400 hours. There was no dispersion of the developer from the surface of the magnetized roll and the toner concentration was easily controlled. Furthermore, the print test, carried out in the same manner as in Example 2, also resulted in a good quality image without edge effects or poor development.

COMPARATIVE EXAMPLE 1

Figure 3:
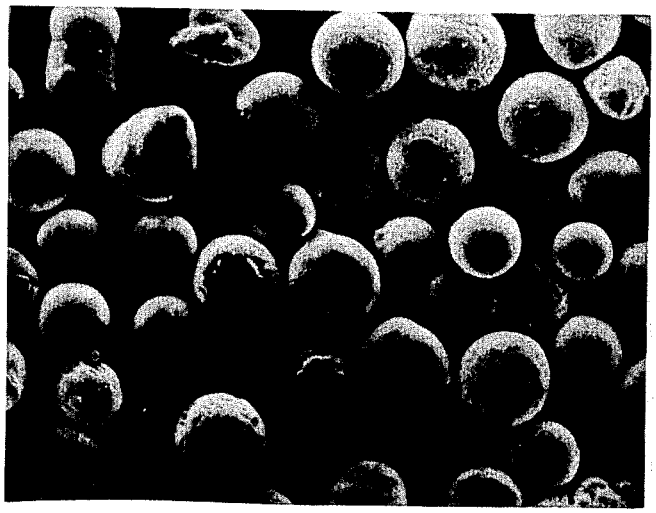
FIG. 3 is a scanning electron microscopic photograph (magnification of 100) of a sample of the carrier in a conventional developer.

The spherical magnetite carrier, TSM-150, manufactured by Nippon Iron Powder Co., Ltd., was prepared, and particles of 100 to 150 microns in size were selected by means of a gyro-shifter. FIG. 3 shows the scanning electron microscopic photograph (magnification of 100) of this carrier. As a result of measurements made in the same manner as in Example 1, the specific surface area of said carrier was about 92.3 $cm^2/g$, the shape factor was about $7.7\times10^{-2}$ and the product of flowability and true specific gravity was about 125 sec/50 g. Thus, the carrier has the specific surface area less than the lower limit of 100 to 300 $cm^2/g$, specified for the present invention.

The developer was obtained by mixing the toner used in Example 1 with the above-mentioned carrier in the weight ratio of 1:99.

A life test was conducted using this developer in the same manner as in Example 1, and the life was found to be about 400 hours. Thus, the developer life was almost the same as the one for the present invention. However, the magnetic force was weak, and there was dispersion of developer from the surface of the magnetized roll. Control of the toner concentration was also quite difficult compared with the developer in Example 1. Furthermore, the print test, conducted in the same manner as in Example 2, resulted in a fairly noticiable edge effect.

COMPARATIVE EXAMPLE 2

Using the spherical magnetite carrier TSM-200, manufactured by Nippon Iron Powder Co., Ltd., particles of 60 to 70 microns in size were selected in the same manner as in Comparative Example 1. As a result of measurements made in the same manner as in Example 1, the specific surface area of the carrier was about 305 $cm^2/g$, the shape factor was about $7.5\times10^{-2}$ and the product of flowability and true specific gravity was about 156 sec/50 g. Thus, said carrier has a specific surface area higher than the upper limit in the range for the present invention.

The developer was prepared by mixing the toner used in Example 1 with the above-mentioned carrier in the weight ratio of 3:97.

As a result of a life test conducted on this developer in the same manner as in Example 1, the life was shown to be about 500 hours which was somewhat longer than the life of the present invention. However, dispersion of the developer from the surface of the magnetized roll was noted as in the case of Comparative Example 1. It was also difficult to control the toner concentration. Furthermore, the print test, carried out in the same manner as in Example 2, resulted in an edge effect on the image.

COMPARATIVE EXAMPLE 3

Using the spherical iron carrier ASRV-10, manufactured by Nippon Iron Powder Co., Ltd., particles of 70 to 100 microns in size were selected in the same manner as Comparative Example 1. As a result of measurements made in the same manner as in Example 1, the specific surface area of the carrier was about 171.7 $cm^2/g$, the shape factor was about $8.0\times10^{-2}$ and the product of flowability and true specific gravity was about 119 sec/50 g. Thus, the carrier has the shape factor exceeding the upper limit for the present invention. The developer was prepared by mixing the toner used in Example 1 with this carrier in the weight ratio of 1:99.

From the life test conducted with the above-mentioned developer in the same manner as in Example 1, the life was found to be about 400 hours. Thus, the developer life was almost the same as the one for the present invention. However, because of its weak magnetic force, dispersion of the developer from the surface of the magnetized roll was noted. It was also difficult to control the toner concentration. Furthermore, in the print test conducted in the same manner as in Example 2, an edge effect was also clearly evidenced.

COMPARATIVE EXAMPLE 4

Figure 4:
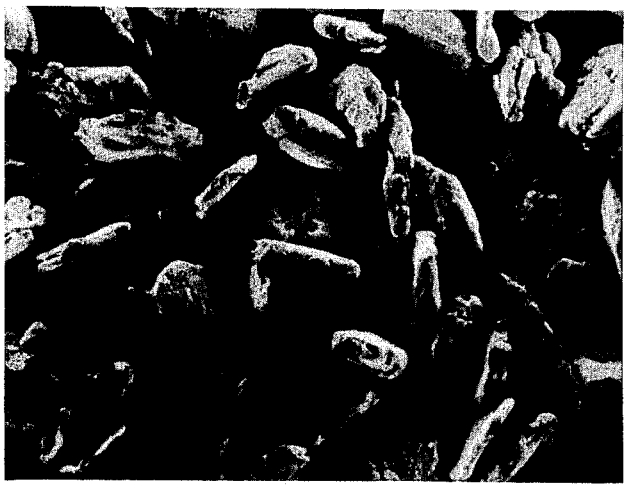
FIG. 4 is a scanning electron microscopic photograph (magnification of 100) of another sample of a carrier in a conventional developer.

After plate-like iron carrier DSP-128B, manufactured by Dowa Iron Powder Industries Co., Ltd., had been prepared and crushed by a vibrating mill for 2 hours, particles of 100 to 150 microns in size were picked up by means of a gyro-shifter. FIG. 4 shows the scanning electron microscopic photograph (magnification of 100) of this carrier. The specific surface area of said carrier, measured in the same manner as in Example 1, was about 204 $cm^2/g$, the shape factor was about $4.4\times10^{-2}$ and the product of flowability and true specific gravity was about 180 sec/50 g. Thus, the carrier has a shape factor below the lower limit specified by the present invention.

Next, by mixing the toner used in Example 1 with the above-mentioned carrier in the ratio of 2:98, the developer was obtained.

As a result of the life test conducted with the developer in the same manner as in Example 1, the life was shown to be about 100 hours. The measured life was less than one-fourth of that for the present invention. However, its magnetic force was strong and no dispersion of developer from the surface of the magnetized roll was observed. Control of the toner concentration was also done easily. Furthermore, as a result of the print test carried out in the same manner as in Example 2, no edge effects were observed.

COMPARATIVE EXAMPLE 5

Semi-spherical iron carrier TSRYV-100, manufactured by Nippon Iron Powder Co., Ltd., was prepared. The specific surface area of this carrier, measured in the same manner as in Example 1, was about 223 $cm^2/g$, the shape factor was about $6.2\times10^{-2}$ and the product of flowability and true specific gravity was 201 sec/50 g. Thus, in this carrier, the product of flowability and true specific gravity is higher than the upper limit specified by the present invention.

Next, a developer was prepared by mixing the toner used in Example 1 with the above-mentioned carrier in the weight ratio of 2:98.

As a result of the same test as in Example 1 conducted with this developer, the life was found to be about 210 hours which was longer than the one found in Comparative Example 4 but was approximately a half of that for the present invention. However, no dispersion of developer from the surface of the magnetized roll was observed. Control of the toner concentration was also easily achieved. In the print test made in the same manner as in Example 2, no edge effects were observed.

COMPARATIVE EXAMPLE 6

Figure 5:
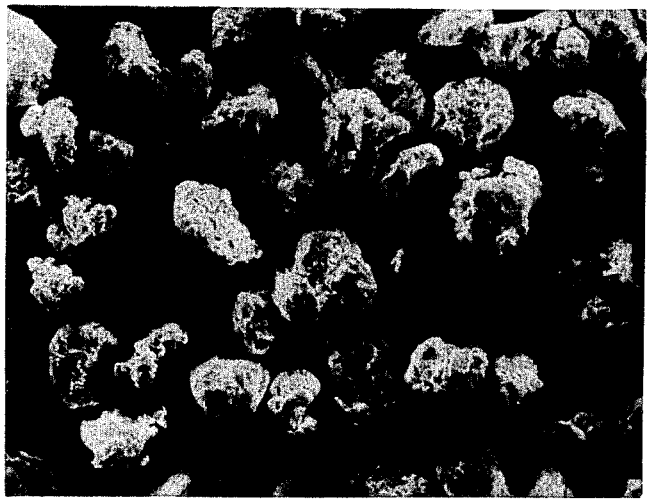
FIG. 5 is a scanning electron microscopic photograph (magnification of 200) of still another sample of carrier in a conventinal developer.

Uncrushed reduced iron powder of the type used in Example 1 was used as the carrier. The scanning electron microscopic photograph (magnification of 200) of this carrier is shown in FIG. 5. The specific surface area of the carrier, measured in the same manner as in Example 1, was about 277 $cm^2/g$, the shape factor was about $5.4\times10^{-2}$ and the product of flowability and true specific gravity was about 197 sec/50 g. Thus, the carrier has both a shape factor below the lower limit in the range specified by the present invention and the product of flowability and true specific gravity higher than the upper limit in the range specified by the present invention.

Next, a developer was prepared by mixing the toner used in Example 1 with the above-mentioned carrier in the weight ratio of 2:98.

From the life test conducted with this developer in the same manner as in Example 1, the life was found to be about 40 hours which was only about one-tenth of that for the present invention. However, there was no dispersion of the developer from the surface of the magnetized roll. Control of the toner concentration was also achieved more easily than with the developer in Example 1. Furthermore, as a result of the printing test carried out in the same manner as in Example 1, contrast of the image was significantly decreased after printing 100,000 pages and, at the same time, image smear was also noted.

I claim:

1. A two-component type dry developer consisting essentially of a mixture of a toner and a magnetic carrier, said toner containing resin as its principal component and being contained in the developer in the range of from 0.5 to 50 weight percent, said carrier being consisted of one member selected from the group consisting of metal, metallic oxide and ferrite, having a specific surface area of 100 to 300 $cm^2/g$, a shape factor of not less than $5.5\times10^{-2}$ and less than $8.0\times10^{-2}$ and a product of flowability and true specific gravity of 100 to 190 sec/50 g and being contained in the developer in the range of from 50 to 99.5 weight percent.

2. A developer as claimed in claim 1, wherein the toner and carrier are in the weight proportions of 1:99 to 25:75.

3. A developer as claimed in claim 1, wherein the resin consists of at least one member selected from the group consisting of natural resin, modified natural resin, synthetic resin, natural rubber and synthetic rubber.

4. A developer as claimed in claim 3, wherein the natural resin consists of at least one member selected from the group consisting of balsam, rosin, shellac and copal.

5. A developer as claimed in claim 3, wherein the modified natural resin consists of at least one member selected from the group consisting of balsam, rosin, shellac and copal, all of which are modified with synthetic resin.

6. A developer as claimed in claim 5, wherein the synthetic resin consists of at least one member selected from the group consisting of vinyl resin, acrylic resin, alkyd resin, phenolic resin, oleo-resin and maleic acid resin.

7. A developer as claimed in claim 3, wherein the synthetic resin consists of at least one member selected from the group consisting of epoxy resin, modified epoxy resin, vinyl resin, acrylic resin, olefin resin, polyamide resin, polyester resin, alkyd resin and amino resin.

8. A developer as claimed in claim 7, wherein the epoxy resin consists of one member selected from the group consisting of phenolic type epoxy resin, aromatic carboxylic acid type epoxy resin, vinyl polymer type epoxy resin and alicyclic compound type epoxy resin.

9. A developer as claimed in claim 8, wherein the epoxy resin is at B-stage.

10. A developer as claimed in claim 9, wherein the B-stage epoxy resin consists of bisphenol-A type epoxy resin containing virtually no oligomer.

11. A developer as claimed in claim 8, wherein the phenolic type epoxy resin consists of one member selected from the group consisting of bisphenol-A type epoxy resin, novolak type epoxy resin, polyphenolic type epoxy resin and polyhydroxybenzene type epoxy resin.

12. A developer as claimed in claim 8, wherein the aromatic carboxylic acid type epoxy resin consists of at least one member selected from the group consisting of hydroxycarboxylic acid type epoxy resin and aromatic dicarboxylic acid type epoxy resin.

13. A developer as claimed in claim 7, wherein the modified epoxy resin is an epoxy resin modified with at least one member selected from the group consisting of phenolic resin, melamine resin, urea resin, xylene resin, polyester resin, polyurethane resin, silicone resin, furfural resin, polyamide resin, acrylic resin, vinyl chloride resin and rubber.

14. A developer as claimed in claim 13, wherein the epoxy resin consists of at least one member selected from the group consisting of phenolic type epoxy resin, aromatic carboxylic acid type epoxy resin, vinyl polymer type epoxy resin and alicyclic compound type epoxy resin.

15. A developer as claimed in claim 14, wherein the phenolic type epoxy resin consists of at least one member selected from the group consisting of bisphenol-A type epoxy resin, novolak type epoxy resin, polyphenol type epoxy resin and polyhydroxybenzene type epoxy resin.

16. A developer as claimed in claim 14, wherein the aromatic carboxylic acid type epoxy resin consists of at least one member selected from the group consisting of hydroxycarboxylic acid type epoxy resin and aromatic dicarboxylic acid type epoxy resin.

17. A developer as claimed in claim 7, wherein the vinyl resin consists of at least one member selected from the group consisting of vinyl chloride resin, vinylidene chloride resin, vinyl acetate resin, polyacetal resin and vinyl ether resin.

18. A developer as claimed in claim 7, wherein the acrylic resin consists of at least one member selected from the group consisting of polyacrylic ester, polymethacrylate ester, copolymer of acrylic acid and copolymer of methacrylic acid.

19. A developer as claimed in claim 7, wherein the olefin resin consists of at least one member selected from the group consisting of polyethylene resin, polypropylene resin, polystyrene resin, copolymer of ethylene and copolymer of styrene.

20. A developer as claimed in claim 7, wherein the polyamide resin consists of at least one member selected from the group consisting of nylon-12, nylon-6 and nylon-66.

21. A developer as claimed in claim 7, wherein the polyester resin consists of at least one member selected from the group consisting of polyethylene terephthalate, polyethylene isophthalate, copolymer of polyethylene terephthalate and polyethylene isophthalate, polytetramethylene terephthalate, polytetramethylene isophthalate and copolymer of polytetramethylene terephthalate and polytetramethylene isophthalate.

22. A developer as claimed in claim 7, wherein the alkyd resin consists of at least one member selected from the group consisting of phthalic acid resin and maleic acid resin.

23. A developer as claimed in claim 7, wherein the amino resin consists of at least one member selected from the group consisting of urea-formaldehyde resin and melamine-formaldehyde resin.

24. A developer as claimed in claim 3, wherein the natural rubber substantially consists of cis-1,4-polyisoprene.

25. A developer as claimed in claim 3, wherein the synthetic rubber consists of at least one member selected from the group consisting of chlorinated rubber, cyclized rubber, isobutylene rubber, ethylene-propylene rubber, ethylene-propylene-diene rubber, butadiene rubber, butyl rubber, styrene-butadiene rubber and acrylonitrile-butadiene rubber.

26. A developer as claimed in claim 1, wherein the toner contains material having a low melting point.

27. A developer as claimed in claim 26, wherein the material having a low melting point is contained in the proportion of 0.1 to 40% by weight.

28. A developer as claimed in claim 26, wherein the material having a low melting point consists of at least one member selected from the group consisting of wax, metallic salt of fatty acid and low molecular weight compound of synthetic resin.

29. A developer as claimed in claim 1, wherein the toner contains a coloring agent.

30. A developer as claimed in claim 29, wherein the coloring agent is contained in the proportion of 0.1 to 15% by weight.

31. A developer as claimed in claim 29, wherein the coloring agent consists of at least one pigment selected from the group consisting of carbon black, acetylene black, lamp black and calcium carbonate.

32. A developer as claimed in claim 29, wherein the coloring agent consists of at least one dyestuff selected from the group consisting of nigrosine and organic complex.

33. A developer as claimed in claim 1, wherein the toner contains a charge control agent.

34. A developer as claimed in claim 33, wherein the charge control agent is contained in the proportion of 0.1 to 15% by weight.

35. A developer as claimed in claim 33, wherein the charge control agent consists of at least one member selected from the group consisting of nigrosine, monoazo dye metallic complex salt and metallic salt of ethendiol derivative.

36. A developer as claimed in claim 1, wherein the average particle size of the toner is between 5 and 50 microns.

37. A developer as claimed in claim 36, wherein the average particle size of the toner is between 8 and 15 microns.

38. A developer as claimed in claim 1, wherein the toner contains virtually no oligomer.

39. A developer as claimed in claim 1, wherein the metal consists of at least one member selected from the group consisting of iron, manganese, cobalt and nickel.

40. A developer as claimed in claim 1, wherein the metallic oxide consists of at least one member selected from the group consisting of iron sesquioxide and tri-iron tetroxide.

41. A developer as claimed in claim 1, wherein the ferrite has a structural formula of $MFe_3O_4$, where M is Mn, Co, Ni, Mg, Zn or Cd.

42. A developer as claimed in claim 1, wherein the particle size of the carrier is between 5 and 300 microns.

43. A developer as claimed in claim 42, wherein the particle size of the carrier is between 10 and 200 microns.

44. A developer as claimed in claim 1, wherein the carrier is coated with a synthetic resin.

45. A developer as claimed in claim 1, wherein the carrier is coated with an oxide.

46. A developer as claimed in claim 45, wherein the coated carrier is further coated with a synthetic resin.

47. A developer as claimed in claim 1, wherein the specific surface area of the carrier is between 120 and 250 $cm^2/g$.

48. A developer as claimed in claim 1, wherein the shape factor of the carrier is not less than $5.5\times10^{-2}$ and not more than $7.0\times10^{-2}$.

49. A developer as claimed in claim 1, wherein the product of the flowability and true specific gravity of the carrier is 120 to 190 sec/50 g.

* * * * *